US010464803B2

(12) United States Patent
Gheorghiu et al.

(10) Patent No.: US 10,464,803 B2
(45) Date of Patent: Nov. 5, 2019

(54) A-FRAME LOADING ARM

(71) Applicant: EMCO WHEATON CORP., Oakville (CA)

(72) Inventors: Daniel Gheorghiu, Burlington (CA); Roelof van der Sleen, Tottenham (CA); Mark Armstrong, Oakville (CA)

(73) Assignee: EMCO WHEATON CORP., Oakville (CA)

( * ) Notice: Subject to any disclaimer, the term of this patent is extended or adjusted under 35 U.S.C. 154(b) by 253 days.

(21) Appl. No.: 15/454,147

(22) Filed: Mar. 9, 2017

(65) Prior Publication Data

US 2018/0257924 A1 Sep. 13, 2018

(51) Int. Cl.

| | |
|---|---|
| ***B67D 7/02*** | (2010.01) |
| ***B67D 7/40*** | (2010.01) |
| ***B67D 7/00*** | (2010.01) |
| ***B67D 9/02*** | (2010.01) |

(52) U.S. Cl.

CPC ..... *B67D 7/002* (2013.01); *B67D 7/0294* (2013.01); *B67D 7/406* (2013.01); *B67D 9/02* (2013.01); *Y10T 137/8807* (2015.04)

(58) Field of Classification Search

CPC . F16L 27/00; B67D 7/002; B67D 9/02; Y10T 137/8807

USPC ..... 137/615

See application file for complete search history.

(56) References Cited

U.S. PATENT DOCUMENTS

| | | | | |
|---|---|---|---|---|
| 4,987,925 A * | 1/1991 | Vroonland | ..... | B67D 7/002 137/615 |
| 5,150,866 A * | 9/1992 | Karpisek | ..... | B65B 39/00 248/281.11 |
| 7,415,990 B2 * | 8/2008 | von Meyerinck | ..... | B64F 1/28 137/615 |

* cited by examiner

*Primary Examiner* — Kevin L Lee

(74) *Attorney, Agent, or Firm* — Michael Best & Friedrich LLP

(57) ABSTRACT

A loading arm includes a stand pipe, a coupler configured to be connected to a tank to deliver a product, and a pipe assembly having a first pipe end pivotally coupled to the stand pipe and a second pipe end pivotally connected to the coupler. The pipe assembly includes a pivot joint disposed between the first pipe end and the second pipe end such that the pipe assembly is movable between a retracted position and an extended position. A linkage assembly has a first portion connected to the pivot joint and a second portion connected to the stand pipe. The linkage assembly is operable to allow for the positioning of the coupler at any of a plurality of points corresponding to the pipe assembly being positioned between the retracted position and the extended position. The linkage assembly is fully supported by the stand pipe such that movement of the pipe assembly does not require manipulating the weight of the linkage assembly.

20 Claims, 11 Drawing Sheets

A-FRAME LOADING ARM

BACKGROUND

Loading arms, and specifically A-frame loading arms are often used to load liquids and other flowable materials into bottom fill transport vehicles such as trucks or rail cars. The loading arms generally include a pipe and a coupling end that is movable from a stowed position to a fill position to engage the vehicle being filled.

BRIEF SUMMARY

In one construction, a loading arm includes a stand pipe, a coupler configured to be connected to a tank to deliver a product, and a pipe assembly having a first pipe end pivotally coupled to the stand pipe and a second pipe end pivotally connected to the coupler. The pipe assembly includes a pivot joint disposed between the first pipe end and the second pipe end such that the pipe assembly is movable between a retracted position and an extended position. A linkage assembly has a first portion connected to the pivot joint and a second portion connected to the stand pipe. The linkage assembly is operable to allow for the positioning of the coupler at any of a plurality of points corresponding to the pipe assembly being positioned between the retracted position and the extended position. The linkage assembly is fully supported by the stand pipe such that movement of the pipe assembly does not require manipulating the weight of the linkage assembly.

In another construction, a loading arm comprising, a stand pipe, a coupler configured to be connected to a tank to deliver a product, and a pipe assembly having a first pipe end pivotally coupled to the stand pipe and a second pipe end pivotally connected to the coupler. The pipe assembly includes a pivot joint disposed between the first pipe end and the second pipe end such that the pipe assembly is movable between a retracted position and an extended position. A balance arm has an upper end connected to the pipe assembly adjacent the pivot joint and a linkage assembly is connected to the balance arm and the stand pipe. A spring can includes a housing and a movable member. The housing is connected to the linkage assembly and the movable member is connected to the stand pipe. The balance arm, the linkage assembly, and the spring can cooperate to allow for the positioning of the coupler at any of a plurality of points corresponding to the pipe assembly being positioned between the retracted position and the extended position. The weight of the spring can is completely supported by the stand pipe and is separated from the pipe assembly such that the weight of the spring can does not effect the movement of the pipe assembly.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
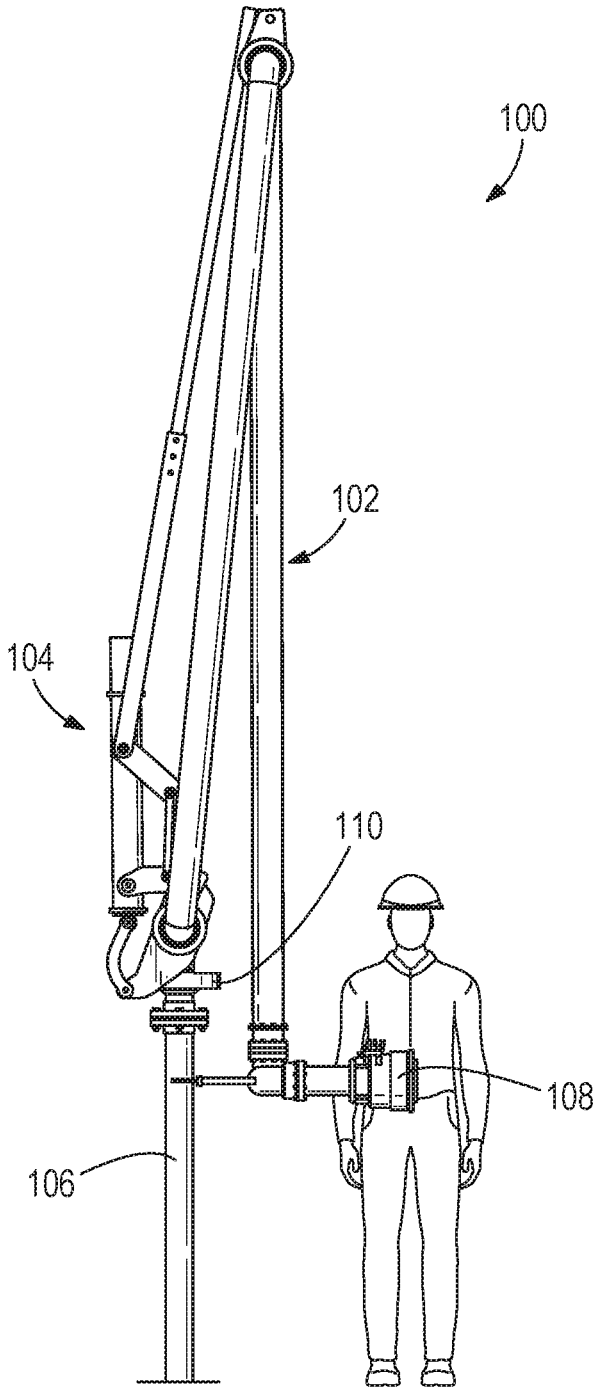
FIG. 1 is a side view of an A-frame loading arm in a retracted position.
Figure 2:
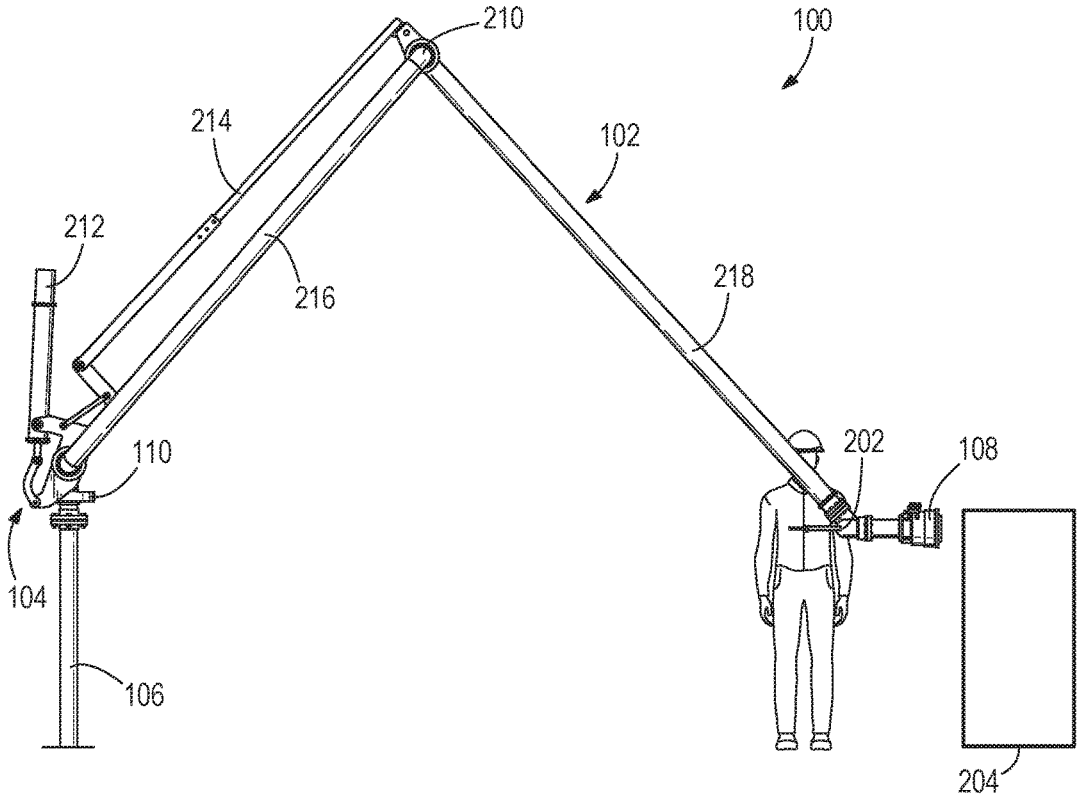
FIG. 2 is a side view of the loading arm of FIG. 1 in the extended position.

FIG. 1 illustrates a loading arm 100, and more particularly an A-frame loading arm 100 that is well suited to delivering bulk goods (typically liquids) to bottom loading devices such as semi-trailer tankers and train car tankers. The loading arm 100 is illustrated in its retracted position with FIG. 2 illustrating the loading arm 100 in an extended position.

The loading arm 100 includes a pipe assembly 102, a linkage assembly 104, a stand pipe 106, and a coupler 108. The stand pipe 106 is a substantially vertical pipe that includes a first end that is fixedly supported in the ground. The height of the stand pipe 106 is selected to position the coupler 108 at a desired height. Thus, different heights can easily be accommodated by changing the height of the stand pipe 106.

The linkage assembly 104 is coupled to a second or top end of the stand pipe 106 via a vertical pivot joint 110. The vertical pivot joint 110 allows the linkage assembly 104 and everything connected to the linkage assembly 104 to rotate about a vertical axis defined by the stand pipe 106. The pipe assembly 102 is connected to the linkage assembly 104 and supports the coupler 108 at the desired operating height. The linkage assembly 104 functions to support the pipe assembly 102 and the coupler 108 as they move between the retracted position and the extended position.

The illustrated coupler 108 is arranged to connect to a fill valve on a bulk transport device or trailer with many different coupler designs being possible.

Turning to FIG. 2, the loading arm 100 is illustrated in the extended position where it is capable of connecting to and filling a tank 204 with product. The pipe assembly 102 includes a first pipe 216 and a second second pipe 218 that are connected to one another by a pivot joint 210. The pivot joint 210 allows the first pipe 216 and the second pipe 218 to move in parallel planes with respect to one another while generally defining an A-shape or an inverted V-shape. The coupler 108 is connected to the second pipe 218 via a coupler pivot joint 202 that allows the coupler 108 to pivot in generally the same plane, or a parallel plane, to the plane of the first pipe 216 or the second pipe 218.

The linkage assembly 104 includes a spring can 212 that provides a counterbalancing force to support the pipe assembly 102 and the coupler 108. As noted, the coupler 108 remains at generally the same height as it moves between the retracted position and the extended position. However, some vertical movement is possible and expected when the coupler 108 is moved.

A balance arm 214 is connected at one end to the linkage assembly 104 and at the opposite end to the pipe assembly 102 adjacent to or near the pivot joint 210. In the illustrated construction, the balance arm 214 is a solid bar member, tube, or, pipe capable of carrying the necessary force to support the pipe assembly 102 as required.

Figure 3:
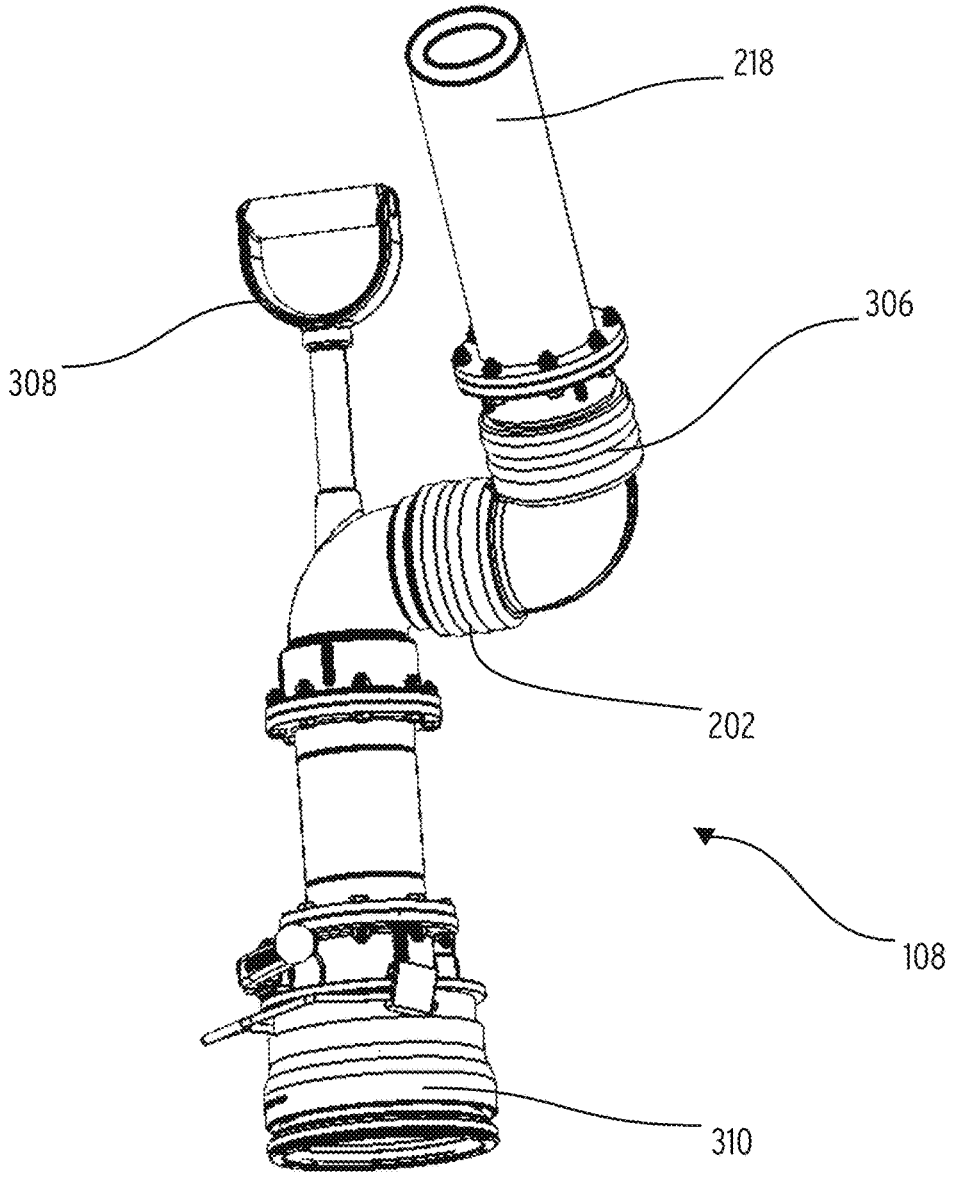
FIG. 3 is an enlarged perspective view of a portion of the loading arm of FIG. 1 including a coupler.

FIG. 3 illustrates the coupler 108 in greater detail. As illustrated, the coupler 108 is connected to the second pipe 218 and includes the coupler pivot joint 202, a second coupler pivot joint 306, a handle 308, and a connector 310. As discussed with regard to FIG. 2, the coupler pivot joint 202 allows the user to pivot the coupler 108 in a plane parallel to the plane of movement of the pipe assembly 102. In the illustrated construction, the second coupler pivot joint 306 provides for rotation in a plane normal to the plane of movement of the pipe assembly 102. This additional degree of freedom allows for more precise control and placement of the connector 310. Other constructions may include more or fewer pivot joints to provide more or fewer degrees of freedom, as may be desired.

The handle 308 is fixedly attached to the portion of the coupler 108 downstream of the coupler pivot joint 202 and the second coupler pivot joint 306 to allow the user to manipulate the handle 308 to produce direct movement of the connector 310. The connector 310 can be any standard connector 310 that is arranged to attach to the connection points on the trailer or rail car being filled or emptied by the loading arm 100.

Figure 4:
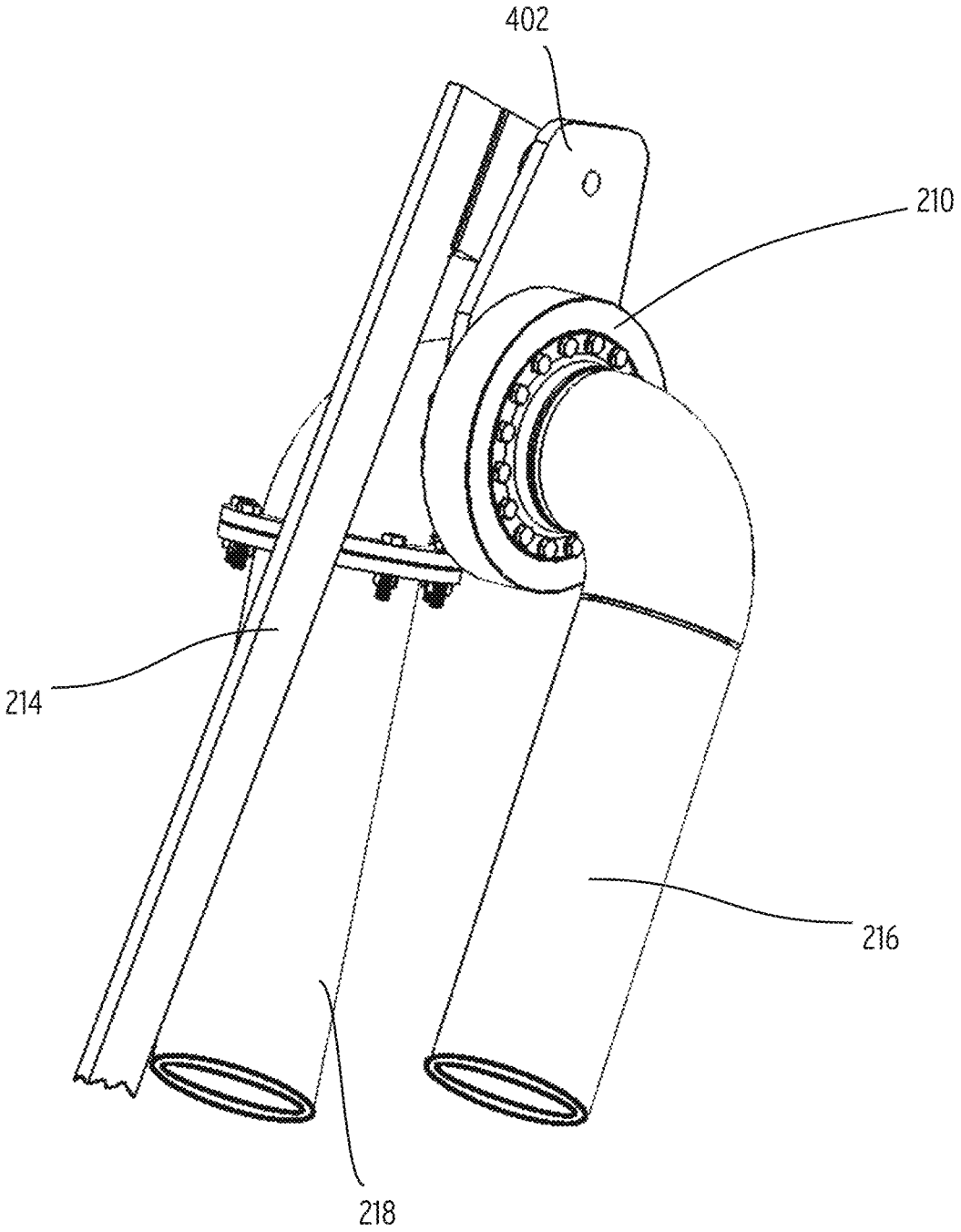
FIG. 4 is a perspective view of a portion of the loading arm including a pivot joint.

Turning to FIG. 4, the pivot joint 210 and the components adjacent the pivot joint 210 are illustrated in greater detail. The pivot joint 210 provides for a movable connection between the first pipe 216 and the second pipe 218 while maintaining a substantially liquid tight seal. The pivot joint 210 allows for relative movement of the first pipe 216 with respect to the second pipe 218 such that the long axis of the first pipe 216 and the second pipe 218 remain substantially parallel to one another.

The balance arm 214 is pivotally attached to a balance plate 402 which is fixedly attached to the second pipe 218. As the second pipe 218 is moved with respect to the first pipe 216, the orientation of the balance plate 402 with respect to the second pipe 218 remains constant which has the affect of changing the relative position of the balance arm 214 with respect to the first pipe 216. The pivot connection between the balance arm 214 and the balance plate 402 allows this movement and change in orientation to freely occur.

Figure 5:
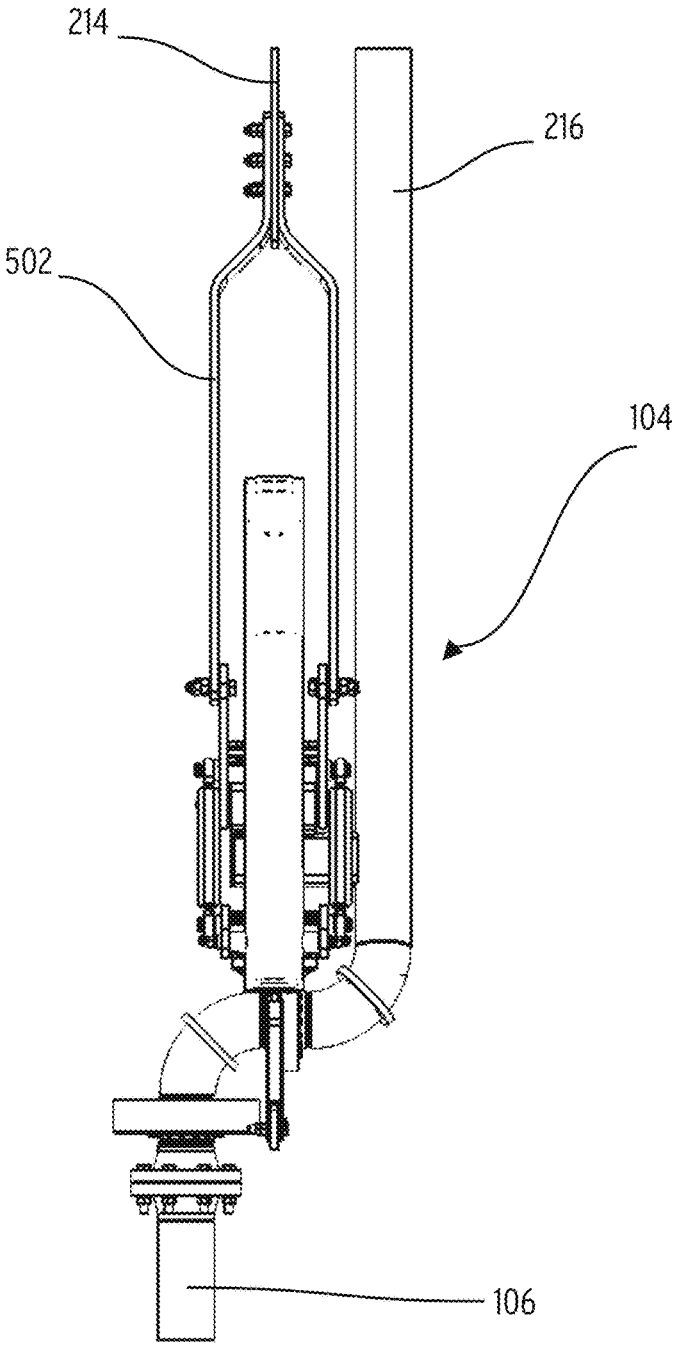
FIG. 5 is a rear view of a portion of the loading arm including a linkage assembly.

As illustrated in FIG. 5, the first pipe 216 is offset from the stand pipe 106. The linkage assembly 104 is positioned between the stand pipe 106 and the first pipe 216 to provide a more compact assembly. In addition, the balance arm 214 includes an end that attaches to a balance arm yoke 502 that connects the balance arm 214 to the linkage assembly 104. This arrangement has the benefit of positioning most or all of the weight of the linkage assembly 104 on the stand pipe 106 rather than on the pipe assembly 102.

Figure 6:
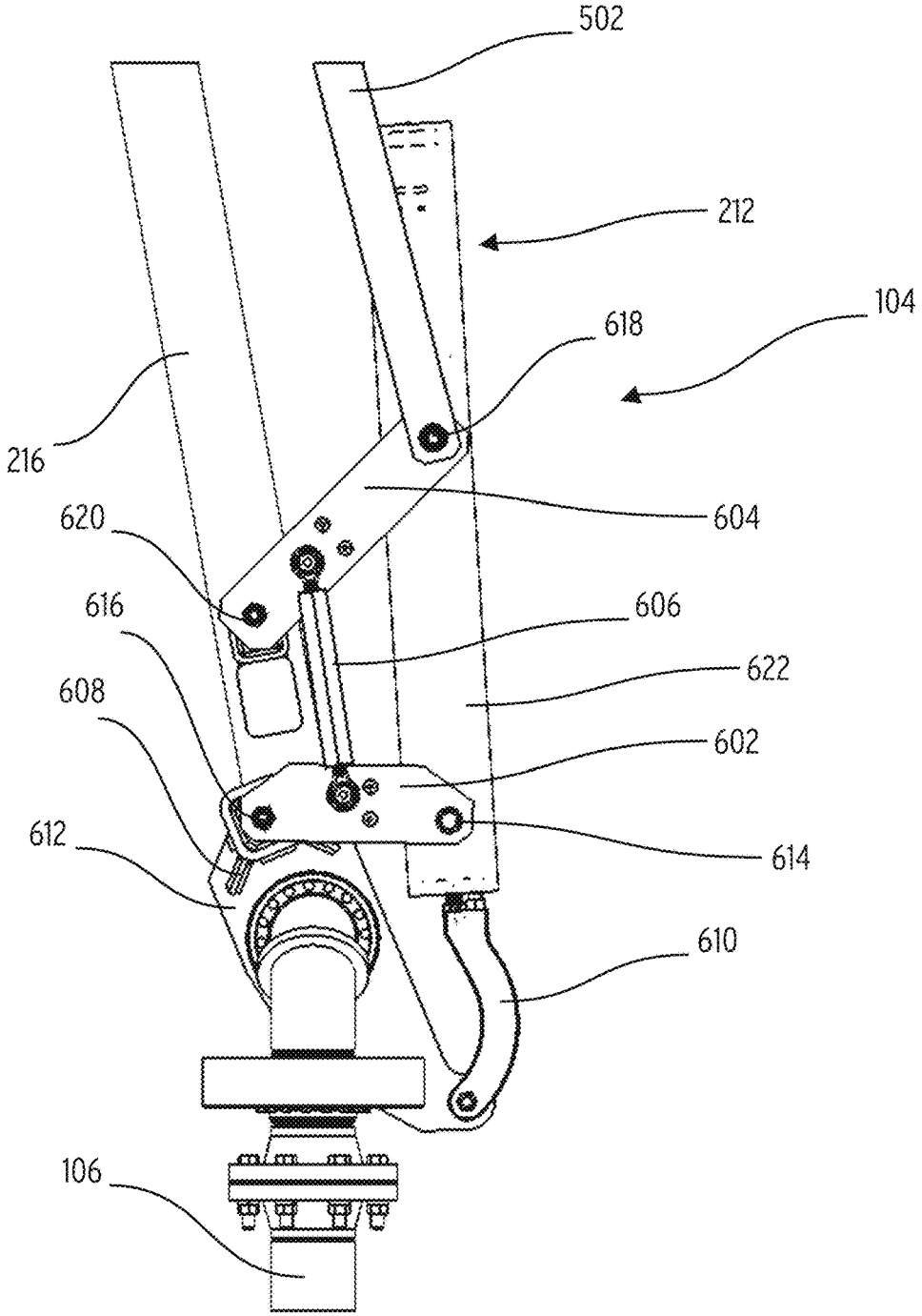
FIG. 6 is a side view of a portion of the loading arm including the linkage assembly.
Figure 7:
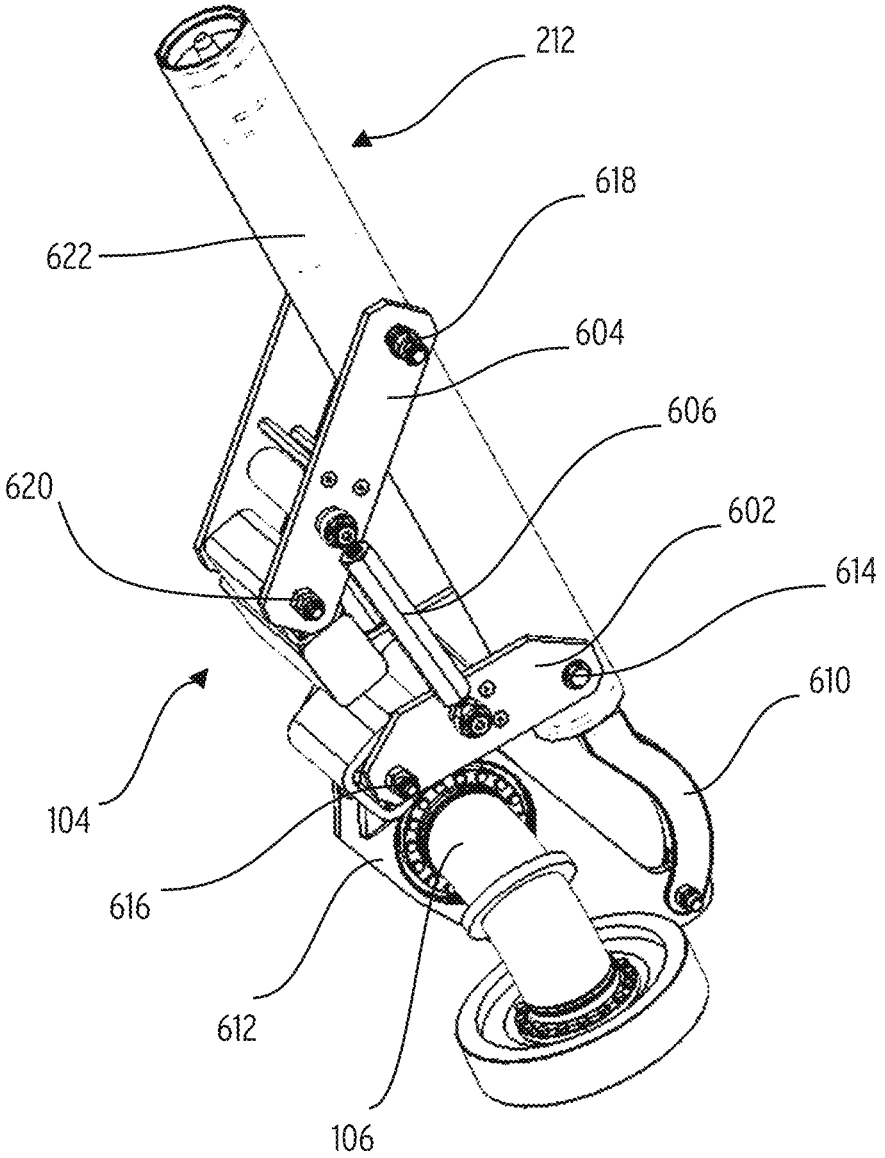
FIG. 7 is a perspective view of a portion of the loading arm including the linkage assembly.

With reference to FIG. 6 and FIG. 7, the linkage assembly 104 is shown in greater detail. As illustrated, the linkage assembly 104 includes the spring can 212, a first yoke member 602, a second yoke member 604, a turnbuckle 606, a banana link 610, and a stand plate 612. The stand plate 612 is a plate member that attaches to the stand pipe 106 and remains substantially fixed with respect to the stand pipe 106. The stand plate 612 includes an uppermost end that includes a slot 608 and a lowermost end that connects to the banana link 610 in a manner that allows the banana link 610 to pivot with respect to the stand plate 612. A second end of the banana link 610 attaches to the spring can 212.

The first yoke member 602 includes two side plates that are substantially the same and that are attached to one another via cross members. The first yoke member 602 includes a first connection 614 that facilitates the connection of the first yoke member 602 to the housing 622 of the spring can 212. The connection between the housing 622 and the first yoke member 602 allows for pivoting movement therebetween but otherwise fixedly attaches the first yoke member 602 to the housing 622 of the spring can 212.

A second connection 616 pivotally engages the slot 608 to allow pivoting movement of the first yoke member 602 with respect to the stand plate 612. However, the second connection 616 fixes the position of the first yoke member 602 with respect to the slot 608. The second connection 616 can be positioned as desired along the slot 608 to adjust the operation of the linkage assembly 104.

The second yoke member 604 is constructed in a manner similar to the first yoke member 602 and includes a first connection 618 that connects the second yoke member 604 to the balance arm yoke 502 as is best illustrated in FIG. 6. The first connection 618 between the second yoke member 604 and the balance arm yoke 502 is pivotal to allow pivotal movement therebetween. It is important to note that the first connection 618 does not connect to the spring can 212. Rather, the spring can 212 is free to move with respect to the first connection 618 between the arms of the balance arm yoke 502.

A second connection 620 is positioned on the end opposite the first connection 618 and facilitates the attachment of the second yoke member 604 directly to the first pipe 216 as illustrated in FIG. 6. The second connection 620 will be described in greater detail with regard to FIG. 8.

The turnbuckle 606 includes a turnbuckle 606 on each side of the first yoke member 602 and the second yoke member 604. Each turnbuckle 606 includes a first end pivotally coupled to the first yoke member 602 between the first connection 614 and the second connection 616 and a second end pivotally connected to the second yoke member 604 between the first connection 618 and the second connection 620. Each turnbuckle 606 includes a pair of threaded members (one at each end) and a rotatable outer member that allows for the easy adjustment of the length of the turnbuckle 606 by rotating the outer member with respect to the threaded members. In preferred constructions, the outer member is hexagonal to allow the use of common hand tools to rotate the outer member. The length adjustment allows the operator to tune the linkage assembly 104 to provide for the desired operation of the loading arm 100.

Figure 8:
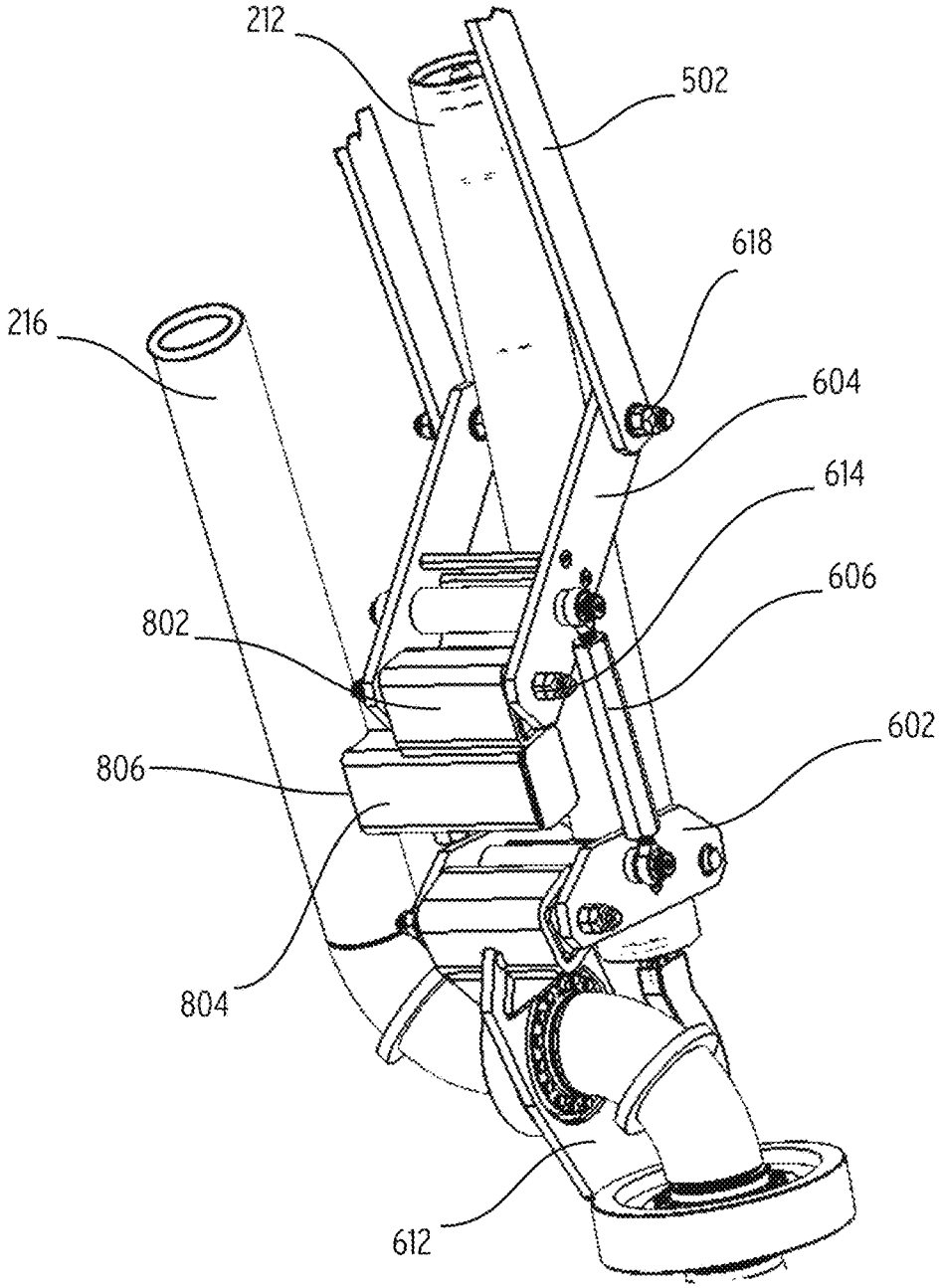
FIG. 8 is another perspective view of a portion of the loading arm of FIG. 1 including the linkage assembly.

FIG. 8 better illustrates the attachment of the second yoke member 604 to the first pipe 216. As illustrated, the second connection 620 includes a spacer 802 that is positioned between the two plate members that partially define the second yoke member 604. A bolt or other threaded member passes through the spacer 802 to allow the spacer 802 to pivot with respect to the remainder of the second yoke member 604. An attachment block 804 is fixedly attached to the spacer 802 and extends away from the second yoke member 604. One end of the attachment block 804 cooperates with the first pipe 216 to define an attachment joint 806 that fixedly attaches the attachment block 804 to the first pipe 216. In a preferred construction, the attachment joint 806 includes a weld joint between the attachment block 804 and the first pipe 216. Other constructions may use other attachment mechanisms.

Figure 9:
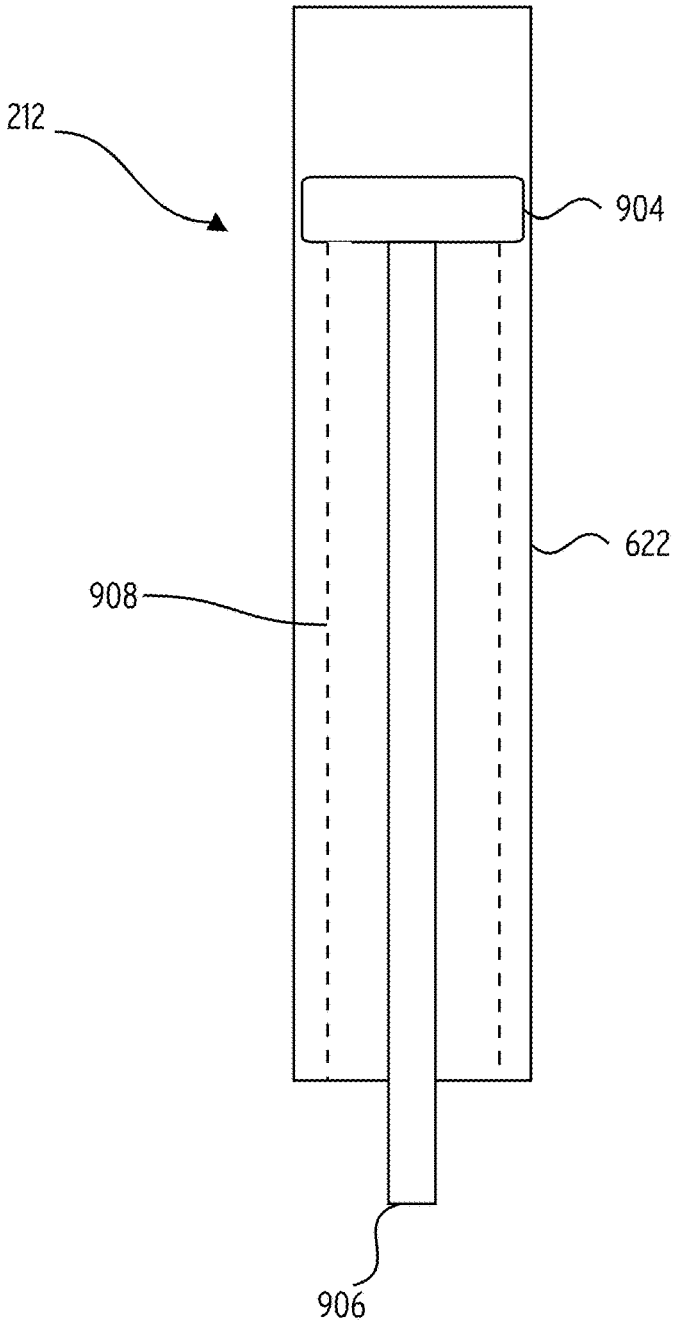
FIG. 9 is a schematic illustration of a spring can.

As illustrated in FIG. 9 the spring can 212 includes a shaft head 904 mounted to a shaft 906 or movable member, and a biasing member 908 in the form of a spring disposed within the housing 622. As the shaft 906 is pulled from the housing 622, the biasing member 908 is compressed between the housing 622 and the shaft head 904, thereby increasing the force resisting the pull of the shaft 906. Thus, the biasing member 908 biases the shaft 906 toward the fully retracted position. As is best illustrated in FIG. 6 and FIG. 7, the banana link 610 pivotally attaches to the shaft 906.

Figure 10:
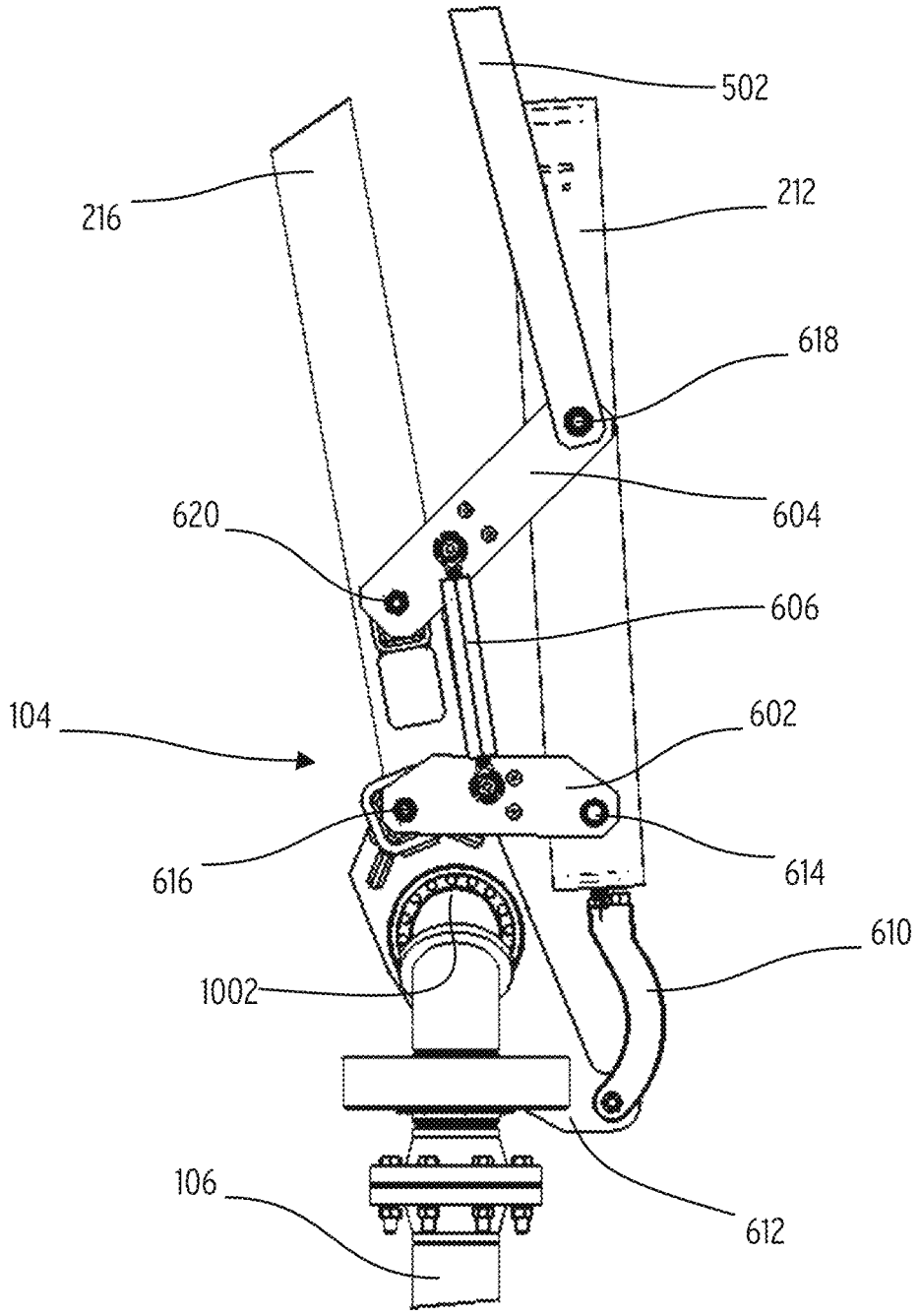
FIG. 10 is a side view of the linkage assembly in the retracted position better illustrating the operation of the loading arm.
Figure 11:
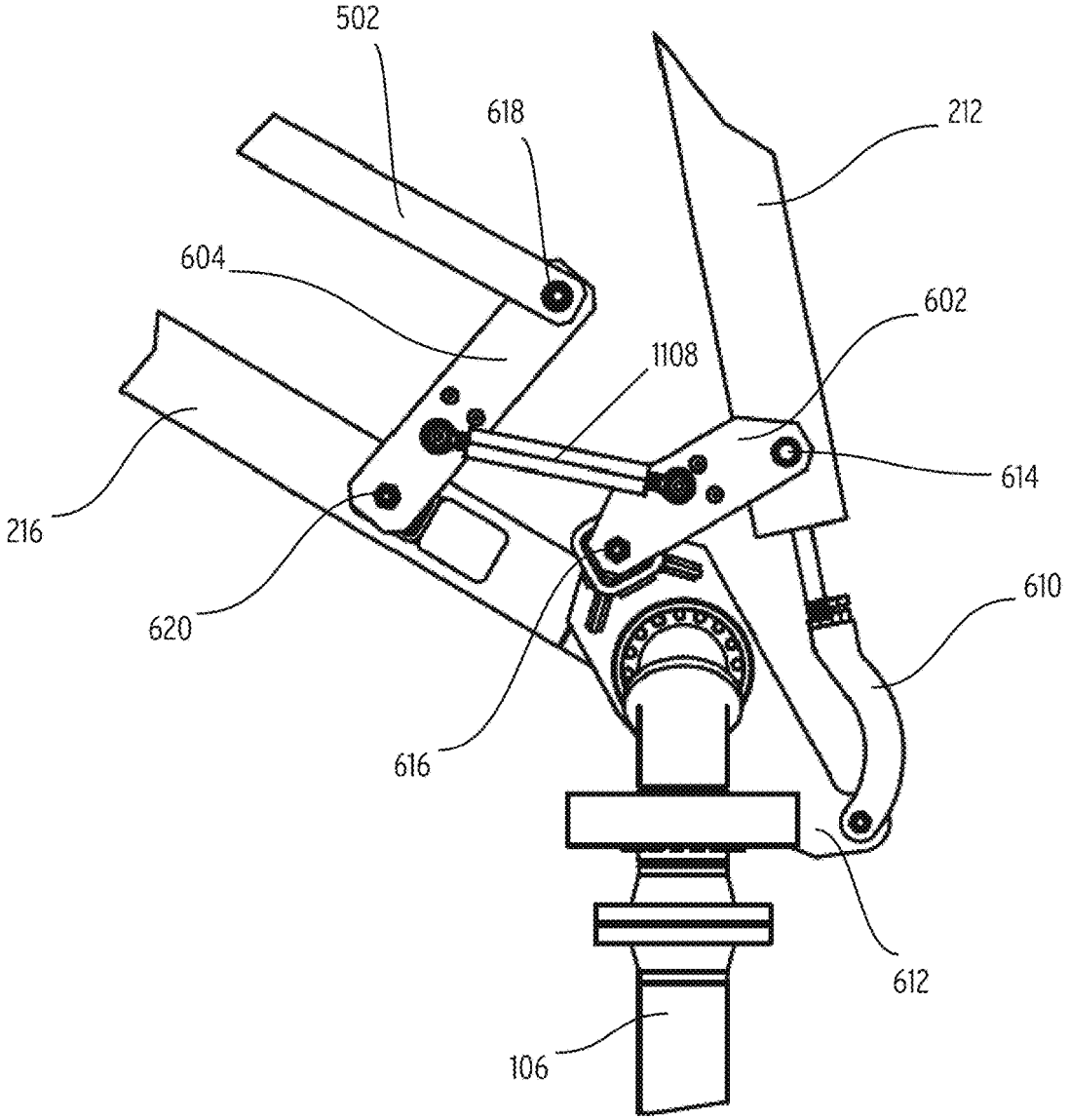
FIG. 11 is a side view of the linkage assembly in the extended position better illustrating the operation of the loading arm.

With reference to FIG. 10 and FIG. 11 the operation of the loading arm 100 and in particular the linkage assembly 104 will now be described. FIG. 10 illustrates the linkage assembly 104 of the loading arm 100 when the loading arm 100 is in the retracted position, while FIG. 11 illustrates the linkage assembly 104 when the loading arm 100 is in the extended position.

Before discussing the movement of the linkage assembly 104, it is important to note the portions that remain substantially stationary. A comparison of FIG. 10 and FIG. 11 will show that the stand pipe 106, the stand plate 612, and the banana link 610 remain substantially fixed. The banana link 610 does have the ability to pivot with respect to the stand plate 612 but little to no other movement occurs.

With reference to FIG. 10, in the retracted position the first pipe 216 and the second pipe 218 are close to the stand pipe 106 and the banana link 610 is positioned close to the spring can 212 (i.e., the shaft 906 is retracted in the housing 622). In this position, the biasing member 908 within the spring can 212 is applying a relatively small biasing force. As the banana link 610 moves outward with respect to the housing 622 of the spring can 212, the biasing force produced by the biasing member 908 increases.

In order to describe the movement of the linkage assembly 104, a center point of an attachment bore 1002 of the stand plate 612 will be assumed to be a fixed reference point. As the user moves the coupler 108 away from the stand pipe 106 to move the loading arm 100 to the extended position, the second yoke member 604 rotates counterclockwise (as illustrated in FIG. 10) to a new position. In this position, the angle between the second yoke member 604 and each of the first pipe 216 and the balance arm yoke 502 changes as the first connection 618 and the second connection 620 allow for only pivotal movement.

The movement of the second yoke member 604 results in a tensile load on the turnbuckle 606, which in turn pulls the first yoke member 602 such that it rotates counterclockwise about the second connection 616. The first connection 614 is a pivotal connection such that the rotation of the first yoke member 602 pulls the housing 622 of the spring can 212 upward with a slight counterclockwise rotation. The movement of the housing 622 with respect to the substantially fixed banana link 610 forces the compression of the biasing member 908 which produces a force in opposition to the movement. This force balances the weight and torque produced by the now extended first pipe 216 and second pipe 218.

The second yoke member 604 is held in the position illustrated in FIG. 11 by the biasing force produced by the spring can 212. The second connection 620 serves to hold the first pipe 216 in the extended position and the first connection 618 holds the second pipe 218 in the extended position. Specifically, the first connection 618 passes a tensile force through the balance arm yoke 502, to the balance arm 214 which applies a tensile force to the balance plate 402. As discussed, the balance plate 402 is substantially fixed to the second pipe 218 such that the applied force holds the second pipe 218 in the extended position.

As illustrated in FIG. 10 and FIG. 11, the turnbuckle 606 can attach to each of the first yoke member 602 and the second yoke member 604 in three different locations. Changing this connection can adjust the overall balance and operation of the linkage assembly 104. In other constructions, more or fewer connection points are provided. Alternatively, slots or other adjustment mechanisms can be employed.

As noted earlier, the second connection 616 includes a slot in the stand plate 612 that allows for the adjustment of this connection as well. Of course other adjustment arrangements could be employed as desired. While the other connections do not include adjustments in the illustrated construction, it is contemplated that all, or some of the connections could include adjustments as desired to provide the best operation of the linkage assembly 104.

It is important to note that the arrangement of the loading arm 100 and in particular the linkage assembly 104 allows the spring can 212 to be almost completely supported directly by the stand pipe 106 such that movement of the coupler 108 does not require the user to also move or manipulate the weight of the spring can 212. In other words, the weight of the spring can 212 is almost completely isolated from the coupler 108, the first pipe 216, and the second pipe 218.

Various features and advantages of the invention are set forth in the following claims.

What is claimed is:

1. A loading arm comprising:

a stand pipe;

a coupler configured to be connected to a tank to deliver a product;

a pipe assembly having a first pipe end pivotally coupled to the stand pipe and a second pipe end pivotally connected to the coupler, the pipe assembly including a pivot joint disposed between the first pipe end and the second pipe end such that the pipe assembly is movable between a retracted position and an extended position; and a linkage assembly having a first portion connected to the pivot joint and a second portion connected to the stand pipe, the linkage assembly operable to allow for the positioning of the coupler at any of a plurality of points corresponding to the pipe assembly being positioned between the retracted position and the extended position, the linkage assembly fully supported by the stand pipe such that movement of the pipe assembly does not require manipulating the weight of the linkage assembly.

2. The loading arm of claim 1, wherein the stand pipe comprises a vertically oriented pipe having a height that is selectable to determine a height of the coupler.

3. The loading arm of claim 1, wherein the pipe assembly comprises a first pipe including the first pipe end and a second pipe including the second pipe end, and wherein the first pipe and the second pipe are connected to one another at the pivot joint.

4. The loading arm of claim 1, wherein the linkage assembly includes a spring can having a housing, a movable member, and a biasing member connected to the housing and the movable member and operable to bias the movable member toward a first position.

5. The loading arm of claim 4, wherein the linkage assembly includes a plate member connected to the stand pipe, a first yoke member connected to the plate member, a second yoke member connected to the pipe assembly, and a turnbuckle connecting the first yoke member and the second yoke member.

6. The loading arm of claim 5, further comprising a banana link that connects the movable member to an end of the plate member.

7. The loading arm of claim 5, wherein the first yoke member includes a first connection pivotally connected to the housing and a second connection pivotally connected to the plate member, and wherein a first end of the turnbuckle connects to the first yoke member between the first connection and the second connection.

8. The loading arm of claim 7, further comprising a balance arm having an upper end connected to the pipe assembly adjacent the pivot joint.

9. The loading arm of claim 8, wherein the second yoke member includes a first connection pivotally connected to the balance arm and a second connection connected to the pipe assembly, and wherein the turnbuckle is connected to the second yoke member between the first connection and the second connection.

10. The loading arm of claim 9, wherein the biasing member produces a biasing force that is applied to the first yoke member, and wherein the biasing force is transmitted to the second yoke member via the turnbuckle, and wherein the turnbuckle applies a tensile force to the second yoke member that balances the weight and the torque produced by the pipe assembly.

11. The loading arm of claim 10, wherein the pipe assembly includes a first pipe and a second pipe, and wherein the tensile force produces a first tensile force at the first connection of the second yoke member that is transmitted through the balance arm to support the second pipe and a second tensile force at the second connection of the second yoke member that supports the first pipe.

12. A loading arm comprising:

a stand pipe;

a coupler configured to be connected to a tank to deliver a product;

a pipe assembly having a first pipe end pivotally coupled to the stand pipe and a second pipe end pivotally connected to the coupler, the pipe assembly including a pivot joint disposed between the first pipe end and the second pipe end such that the pipe assembly is movable between a retracted position and an extended position;

a balance arm having an upper end connected to the pipe assembly adjacent the pivot joint;

a linkage assembly connected to the balance arm and the stand pipe; and a spring can including a housing and a movable member, the housing connected to the linkage assembly and the movable member connected to the stand pipe, the balance arm, the linkage assembly, and the spring can cooperating to allow for the positioning of the coupler at any of a plurality of points corresponding to the pipe assembly being positioned between the retracted position and the extended position, wherein the weight of the spring can is completely supported by the stand pipe and is separated from the pipe assembly such that the weight of the spring can does not effect the movement of the pipe assembly.

13. The loading arm of claim 12, wherein the stand pipe comprises a vertically oriented pipe having a height that is selectable to determine a height of the coupler.

14. The loading arm of claim 12, wherein the spring can comprises a biasing member connected to the housing and the movable member and wherein the biasing member is operable to bias the movable member toward a first position.

15. The loading arm of claim 14, wherein the linkage assembly includes a plate member connected to the stand pipe, a first yoke member connected to the plate member, a second yoke member connected to the pipe assembly, and a turnbuckle connecting the first yoke member and the second yoke member.

16. The loading arm of claim 15, wherein the first yoke member includes a first connection connected to the housing and a second connection connecting the first yoke member to the plate member, and wherein a first end of the turnbuckle connects to the first yoke member between the first connection and the second connection.

17. The loading arm of claim 15, further comprising a banana link that connects the movable member to a second end of the plate member.

18. The loading arm of claim 15, wherein the second yoke member includes a first connection connected to the balance arm and a second connection connected adjacent the first pipe end of the pipe assembly, and wherein the turnbuckle is connected to the second yoke member between the first connection and the second connection.

19. The loading arm of claim 18, wherein the biasing member produces a biasing force that is applied to the first yoke member, and wherein the biasing force is transmitted to the second yoke member via the turnbuckle, and wherein the turnbuckle applies a tensile force to the second yoke member that balances the weight and the torque produced by the pipe assembly.

20. The loading arm of claim 19, wherein the pipe assembly includes a first pipe and a second pipe, and wherein tensile force produces a first tensile force at the first connection of the second yoke member that is transmitted through the balance arm to support the second pipe and a second tensile force at the second connection of the second yoke member that supports the first pipe.

* * * * *